US009291165B2

(12) United States Patent
Obrist et al.

(10) Patent No.: US 9,291,165 B2
(45) Date of Patent: Mar. 22, 2016

(54) SCROLL-TYPE COMPRESSOR AND CO2 VEHICLE AIR CONDITIONING SYSTEM HAVING A SCROLL-TYPE COMPRESSOR

(71) Applicant: Obrist Engineering GmbH, Lustenau (AT)

(72) Inventors: Frank Obrist, Bregenz (AT); Oliver Obrist, Dornbirn (AT); Christian Schmaelzle, Lauterach (AT); Christian Busch, Feldkirch (AT)

(73) Assignee: OBRIST ENGINEERING GMBH, Lustenau (AT)

( * ) Notice: Subject to any disclaimer, the term of this patent is extended or adjusted under 35 U.S.C. 154(b) by 0 days.

(21) Appl. No.: 14/282,540

(22) Filed: May 20, 2014

(65) Prior Publication Data

US 2014/0348682 A1 Nov. 27, 2014

(30) Foreign Application Priority Data

May 22, 2013 (EP) ..... 13168737

(51) Int. Cl.
*F03C 2/00* (2006.01)
*F03C 4/00* (2006.01)
(Continued)

(52) U.S. Cl.
CPC ..... *F04C 29/0057* (2013.01); *F04C 18/0207* (2013.01); *F04C 18/0215* (2013.01); *F04C18/0253* (2013.01); *F04C 27/005* (2013.01); *F04C 29/126* (2013.01); *F04C 23/008* (2013.01); *F04C 28/265* (2013.01); *F04C 2210/1027* (2013.01); *F04C 2210/261* (2013.01); *F04C 2240/40* (2013.01); *F04C 2240/807* (2013.01)

(58) Field of Classification Search
CPC ..... F04C 18/0207; F04C 18/0215; F04C 18/0253; F04C 23/008; F04C 27/005; F04C 29/005; F04C 29/02; F04C 29/026; F04C 29/124; F04C 29/126; F04C 29/128; F04C 2210/1027; F04C 2210/261; F04C 2240/807; F04C 2240/40
USPC ..... 418/55.1–55.6, 57, 151, 270, DIG. 1
See application file for complete search history.

(56) References Cited

U.S. PATENT DOCUMENTS 3,463,091 A * 8/1969 Delsuc ..... 418/57
3,817,664 A * 6/1974 Bennett et al. ..... 418/55.1
(Continued)

FOREIGN PATENT DOCUMENTS

EP 1087142 3/2001
JP 62063189 3/1987
(Continued)

OTHER PUBLICATIONS

European Search Report for EP 13168737, Completed by the European Patent Office on Sep. 23, 2013, 4 Pages.

*Primary Examiner* — Theresa Trieu
(74) *Attorney, Agent, or Firm* — Brooks Kushman P.C.

(57) ABSTRACT

A scroll-type compressor for a $CO_2$ vehicle air conditioning system, having a mechanical drive which is connected by a drive shaft to an eccentric bearing. A movable displacement spiral is rotatably connected to the eccentric bearing and engages into a counterpart spiral such that, between the displacement spiral and the counterpart spiral, radially inwardly traveling chambers are formed in order to compress the refrigerant and discharge it into a pressure chamber. Wherein the counterpart spiral is movable in alternating fashion relative to the displacement spiral in an axial direction, wherein, between the counterpart spiral and the displacement spiral, there is arranged at least one spring for exerting an axial release force on the counterpart spiral, and at least one piston engages on the counterpart spiral, in order to exert an axial closing force on the latter, adjacent to the pressure chamber in an off-center position.

15 Claims, 6 Drawing Sheets

(51) Int. Cl.

| | |
|---|---|
| ***F04C 2/00*** | (2006.01) |
| ***F04C 18/00*** | (2006.01) |
| ***F04C 29/00*** | (2006.01) |
| ***F04C 27/00*** | (2006.01) |
| ***F04C 18/02*** | (2006.01) |
| ***F04C 29/12*** | (2006.01) |
| *F04C 23/00* | (2006.01) |
| *F04C 28/26* | (2006.01) |

(56) References Cited

U.S. PATENT DOCUMENTS

| | | | | | |
|---|---|---|---|---|---|
| 3,874,827 | A | * | 4/1975 | Young | 418/55.2 |
| 4,435,137 | A | * | 3/1984 | Terauchi | 418/55.5 |
| 4,610,610 | A | * | 9/1986 | Blain | 418/55.5 |
| 4,927,339 | A | * | 5/1990 | Riffe et al. | 418/55.5 |
| 5,199,280 | A | * | 4/1993 | Riffe et al. | 418/55.5 |
| 6,273,692 | B1 | | 8/2001 | Kitano et al. | |
| 2002/0081224 | A1 | | 6/2002 | Ueda et al. | |
| 2003/0147763 | A1 | | 8/2003 | Sakuda et al. | |
| 2003/0194340 | A1 | | 10/2003 | Ni | |
| 2005/0261141 | A1 | | 11/2005 | Iso et al. | |
| 2006/0159580 | A1 | | 7/2006 | Matsuhashi | |
| 2008/0226483 | A1 | | 9/2008 | Iwanami et al. | |
| 2009/0068046 | A1 | | 3/2009 | Kishikawa et al. | |
| 2009/0098001 | A1 | | 4/2009 | Ni | |

FOREIGN PATENT DOCUMENTS

| | | |
|---|---|---|
| JP | 07091384 | 4/1995 |
| JP | 2006144635 | 6/2006 |

* cited by examiner

SCROLL-TYPE COMPRESSOR AND CO2 VEHICLE AIR CONDITIONING SYSTEM HAVING A SCROLL-TYPE COMPRESSOR

CROSS-REFERENCE TO RELATED APPLICATIONS

This Application claims priority to EP Patent Application No. EP 13168737.8 filed on May 22, 2013, the disclosure of which is incorporated in its entirety by reference herein.

TECHNICAL FIELD

The invention relates to a scroll-type compressor for a $CO_2$ vehicle air conditioning system, and to a $CO_2$ vehicle air conditioning system having a scroll-type compressor of said type.

BACKGROUND

For the air conditioning of motor vehicles, use is made of non-combustible refrigerants in order to avoid the risk of an explosion in the vehicle interior compartment in the event of an accident. The refrigerants that have hitherto been used have, however, either already been banned, or are at least regarded as problematic, owing to their high global warming potential. One possible environmentally compatible, non-combustible refrigerant is $CO_2$ (R744), which has already partially replaced the previous refrigerants. $CO_2$ air conditioning systems, however, operate with high operating pressures, which place particularly high demands on the strength and sealing action of the system components. The advantage associated with the high operating pressure consists in that, owing to the relatively high density of $CO_2$, a lower volume flow rate is required to obtain a relatively high level of cooling power.

A scroll-type compressor for a $CO_2$ vehicle air conditioning system is known from JP 2006/144635 A. In general, scroll-type compressors of said type have rotational-speed-regulated electric drives in order to control the refrigeration power of the compressor. In conjunction with vehicle air conditioning systems that operate with conventional, low-pressure refrigerants, scroll-type compressors of simple construction are also known in which power regulation is realized by virtue of the compressor being activated or deactivated.

Accordingly, U.S. Pat. No. 6,273,692 B1 discloses a scroll-type compressor having a mechanical drive which can be connected to the compressor unit by means of an electromagnetic clutch. Such clutches generally have a heavy steel disk. The mass moment of inertia is therefore high, which has a correspondingly adverse effect on fuel consumption. Furthermore, the clutch is an expensive component. US 2002/0081224 A1 discloses a variable low-pressure scroll-type compressor which can be activated and deactivated by means of a radial movement of one of the two scroll spirals. Here, the eccentricity between the two scroll spirals is eliminated, which scroll spirals accordingly pass out of engagement in the radial direction.

SUMMARY

The invention is based on the object of specifying a scroll-type compressor for a $CO_2$ vehicle air conditioning system, which scroll-type compressor is of simple construction and permits power regulation. The invention is furthermore based on the object of specifying a $CO_2$ vehicle air conditioning system having a scroll-type compressor of said type.

According to the invention, the object is achieved by means of a scroll-type compressor for a $CO_2$ vehicle air conditioning system having the features of the claims. With regard to the $CO_2$ vehicle air conditioning system, the object is achieved by a vehicle air conditioning system that includes $CO_2$ as refrigerant and that has a scroll-type compressor as claimed.

The invention has numerous advantages.

The use of a mechanical drive or of an electric drive with a fixed rotational speed, that is to say a rotational speed that does not vary with time, permits a design which is inexpensive in relation to rotational-speed-regulated compressors. Power regulation is performed by means of the alternating movement of the counterpart spiral relative to the displacement spiral in the axial direction. By means of said movement, a pressure equalization gap is formed temporarily between the counterpart spiral and the displacement spiral, such that compressed gas can flow radially outward from those chambers of the compressor which are situated radially further to the inside. The pressure in the scroll-type compressor is depleted in this way. Here, the displacement spiral continues to rotate, such that a clutch for interrupting the power flow between the drive and the displacement spiral is not required. The scroll-type compressor according to the invention can therefore be implemented without a clutch.

The implementation of the scroll-type compressor as a clutchless compressor leads to a significant reduction in the mass moment of inertia. Since the displacement spiral co-rotates in the load-free state, the start-up torque is eliminated in the scroll-type compressor according to the invention. Furthermore, the loading of the rotating components is greatly reduced, and fuel consumption is lowered. The scroll-type compressor according to the invention exhibits very smooth running and low noise.

The alternating movement of the counterpart spiral is effected by way of an axial release force and a closing force that opposes said axial release force. According to the invention, the axial release force is produced by a spring which is arranged between the displacement spiral and the counterpart spiral. The release force lifts the counterpart spiral from the displacement spiral, such that the pressure equalization gap is formed in between and the scroll-type compressor is deactivated (open position). For the axial closing force, a piston is provided which engages on the counterpart spiral adjacent to the pressure chamber. The closing force places the counterpart spiral in contact with the displacement spiral. In the process, the pressure equalization gap is closed, and the scroll-type compressor is activated (closed position).

The arrangement according to the invention of the spring and of the piston leads to a compact and robust construction of the scroll-type compressor, the power of which can be regulated by means of the alternating movement of the counterpart spiral. The arrangement of the piston adjacent to the pressure chamber has the effect that the pressure chamber can be connected directly to the outlet for the compressed gas formed in the counterpart spiral. The pressure chamber can thus be implemented without internals, whereby problems with regard to the sealing action in the region of the pressure chamber can be avoided.

By comparison with the prior art, the invention makes it possible for scroll-type compressors for $CO_2$ vehicle air conditioning systems to be constructed whose mass moment of inertia is lower, by an overall factor of 3, than that of known scroll-type compressors. In absolute numbers, the invention makes it possible for scroll-type compressors to be constructed which have a maximum mass moment of inertia of 500 $kgmm^2$.

Preferred embodiments are specified in the subclaims.

A particularly space-saving design can be realized by means of the preferred arrangement of the spring opposite the pressure chamber. If the piston additionally comprises an annular piston which is arranged so as to be displaceable coaxially with respect to the counterpart spiral, the overall result is a robust construction for the introduction of the release and closing forces into the counterpart spiral. The annular piston moreover has the advantage that the closing force is introduced over a relatively large surface area, whereby the surface pressure of the piston required for the closing force is distributed uniformly.

The pressure differences that exist in any case between the high-pressure side and the suction side of the scroll-type compressor are utilized for the actuation of the piston if the piston is mounted in a piston guide which can be connected to the high-pressure side and to the suction side of the scroll-type compressor in alternating fashion. To prevent compressed gas from flowing from the high-pressure side to the suction side, and the displacement spiral rotating backward, in the event of the counterpart spiral being lifted from the displacement spiral, a check valve is positioned downstream of the pressure chamber in the flow direction. In a further preferred embodiment, the pressure chamber has a dual function and serves firstly for the damping of gas pulsations and secondly as a guide for the counterpart spiral. For this purpose, a rear wall, arranged on the high-pressure side, of the counterpart spiral forms the base of the pressure chamber, wherein the counterpart spiral has a flange which bears in axially movable fashion against an inner wall of the pressure chamber. Said dual function contributes to the compact design of the scroll-type compressor.

The sealing action can be improved if an accommodating space, which is closed off with respect to the suction side, for the eccentric bearing is fluidically connected to the pressure chamber, and a rear wall of the displacement spiral can be acted on with a surface pressure.

It has been found that a relatively small eccentricity is sufficient for adequate compression of the refrigerant. For this purpose, the distance between the central point of the counterpart spiral and the central point of the displacement spiral may be at most 1.5 mm, in particular at most 1.2 mm, in particular at most 1.0 mm, in particular at most 0.8 mm, in particular at most 0.6 mm, in particular at most 0.4 mm, in particular at most 0.2 mm. The lower limit may be 0.1 mm. It is preferable for the counterpart spiral to have a winding angle of 660° to 720°, in particular of 680° to 700°, whereby adequate compression of the refrigerant is achieved.

In a further preferred embodiment, it is provided that the eccentric bearing is arranged in the displacement chamber between the displacement spiral and the counterpart spiral and has a bearing bushing which is formed integrally with the displacement spiral and the base of which is in alignment with the face side of the windings of the displacement spiral. Thus, the bearing bushing of the eccentric bearing is arranged so as to be recessed in the direction of the high-pressure side, wherein the eccentric bearing is situated at least partially at the level of the windings of the counterpart spiral. The eccentric bearing thus protrudes into the counterpart spiral. The innermost volume, which in the case of the known low-pressure scroll-type compressors is utilized for the final compression stage, between the displacement spiral and the counterpart spiral is, in this embodiment, at least partially utilized for forming the bearing bushing and thus for accommodating the eccentric bearing. In this way, any tilting moments are reduced, and running smoothness is improved. Furthermore, said embodiment has the further advantage that the bearing bushing, arranged in a recessed position, forms an abutment surface for the spring between the displacement spiral and the counterpart spiral. Said embodiment is therefore particularly advantageous in conjunction with the arrangement of the spring opposite the pressure chamber.

Any tilting moments are further reduced if the displacement spiral has a central recess in which there is at least partially accommodated a counterweight which is connected to the eccentric bearing. The volume of the pressure chamber is preferably greater by a factor of 5-7, in particular by a factor of 6, than the suction volume per revolution of the displacement spiral, whereby gas pulsations can be reduced in an effective manner.

The invention will be explained in more detail with reference to the appended schematic drawings and on the basis of exemplary embodiments.

DETAILED DESCRIPTION

Figure 1:
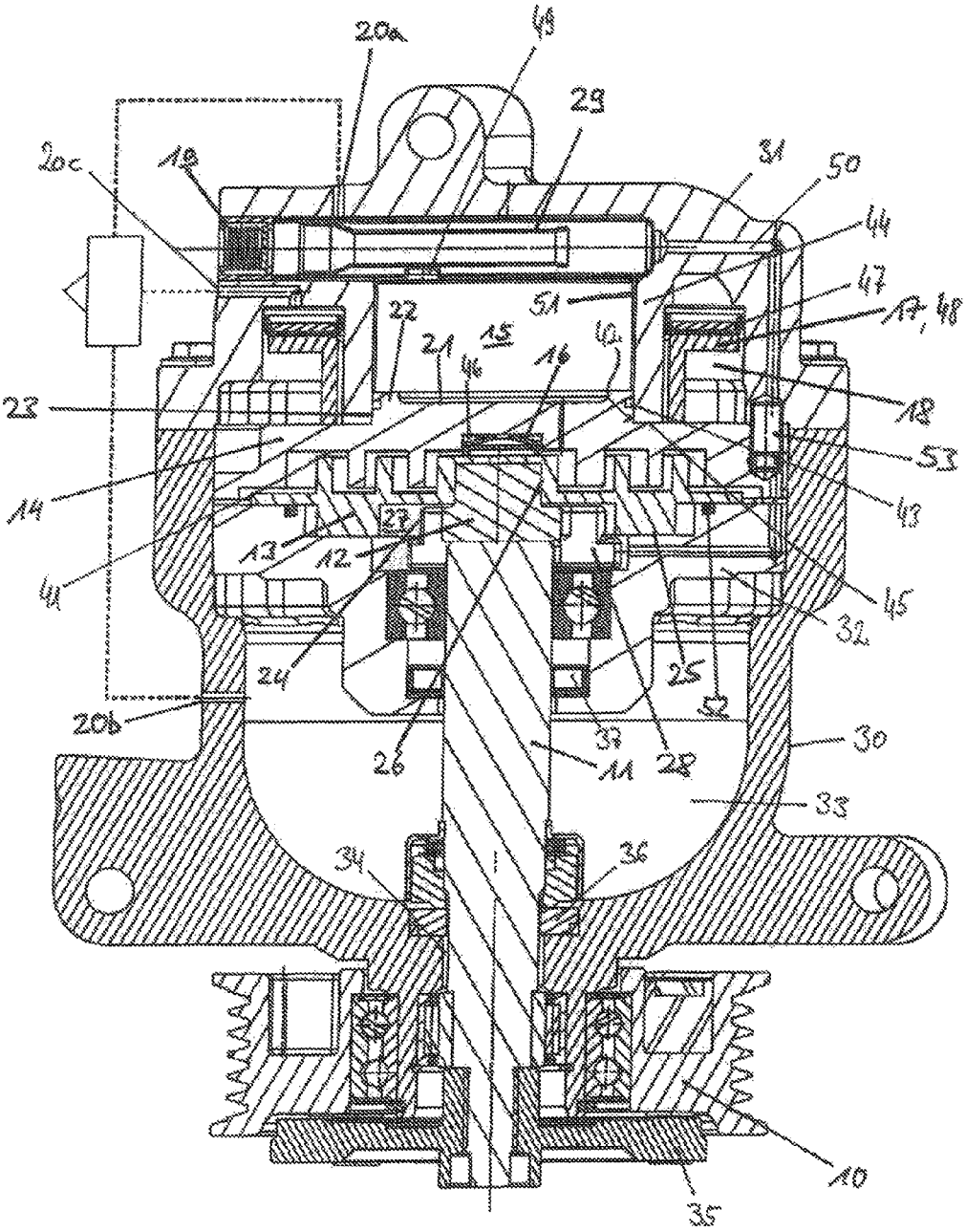
FIG. 1 shows a longitudinal section through a scroll-type compressor as per one exemplary embodiment according to the invention in the open position.
Figure 2:
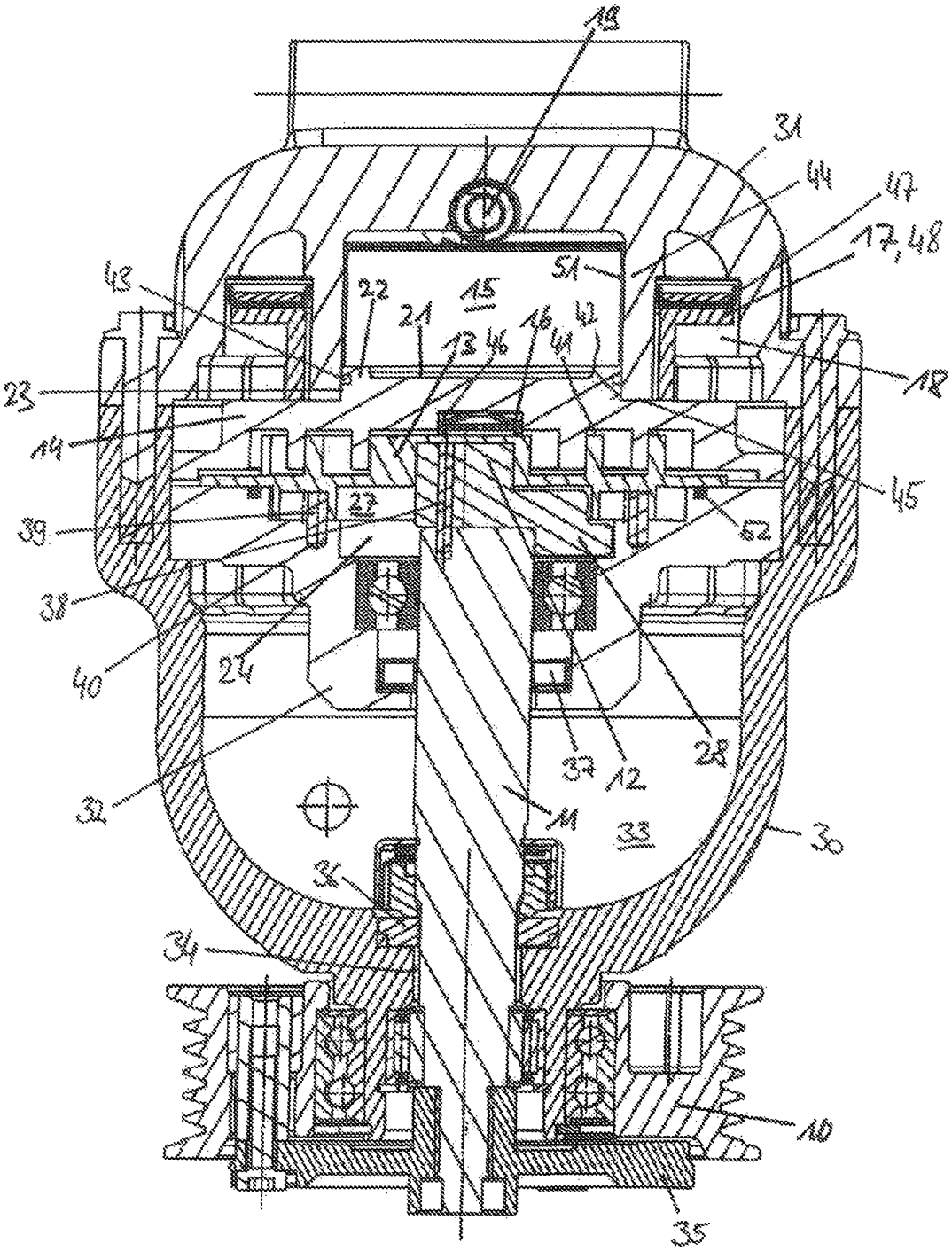
FIG. 2 shows a further longitudinal section through the scroll-type compressor as per FIG. 1, illustrating the construction of the eccentric bearing.

The scroll-type compressor described in detail below is designed for use in a $CO_2$ vehicle air conditioning system which typically comprises a gas cooler, an internal heat exchanger, a throttle, an evaporator and a compressor. Such systems are designed for maximum pressures of over 100 bar. The compressor is a scroll-type compressor, also referred to as a spiral-type compressor. As illustrated in FIGS. 1 and 2, the scroll-type compressor has a mechanical drive 10 in the form of a belt pulley. The belt pulley is, during use, connected to an electric motor or to an internal combustion engine.

The scroll-type compressor furthermore comprises a housing 30 with a housing cover 31 which closes off the high-pressure side of the compressor and which is screwed to the housing 30. In the housing 30 there is arranged a housing intermediate wall 32 which delimits a suction chamber 33. In the housing base 34 there is formed a passage opening through which a drive shaft 11 extends. That shaft end which is arranged outside the housing 30 is connected rotationally conjointly to a driver 35 which engages into the belt pulley rotatably mounted on the housing 30, such that a torque can be transmitted from the belt pulley to the drive shaft 11. The drive shaft 11 is rotatably mounted at one side in the housing base 34 and at the other side in the housing intermediate wall 32. The drive shaft 11 is sealed with respect to the housing base 34 by means of a first shaft seal 36 and with respect to the housing intermediate wall 32 by means of a second shaft seal 37.

The drive shaft 11 transmits the torque to a compressor unit, which is constructed as follows.

The compressor unit comprises a movable displacement spiral 13 and a counterpart spiral 14. The displacement spiral 13 and the counterpart spiral 14 engage into one another. The counterpart spiral 14 is fixed in the circumferential direction and in the radial direction. The movable displacement spiral 13, which is coupled to the drive shaft 11, describes a circular path, such that, in a known way, said movement causes multiple gas pockets or gas chambers to be generated which travel radially inward between the displacement spiral 13 and the counterpart spiral 14. By means of said orbiting movement, refrigerant vapor is drawn into the open gas chamber at the outside and is compressed by way of the further spiral movement and the associated reduction in size of the gas chamber. The refrigerant vapor is compressed in linearly progressive fashion from radially outside to radially inside, and is discharged, at the center of the counterpart spiral 14, into a pressure chamber 15.

For the orbiting movement of the displacement spiral 13, there is provided an eccentric bearing 12 which is connected to the drive shaft by means of an eccentric pin 38 (see FIG. 2). The eccentric bearing 12 and the displacement spiral 13 are arranged eccentrically with respect to the counterpart spiral 14. The gas chambers are separated from one another in pressure-tight fashion by abutment of the displacement spiral 13 against the counterpart spiral 14. The radial surface pressure between the displacement spiral 13 and the counterpart spiral 14 is set by means of the eccentricity.

A rotational movement of the displacement spiral is prevented by means of multiple guide pins 39 which, as illustrated in FIG. 2, are fastened in the intermediate wall 32. The guide pins 39 engage into corresponding guides bores 40 that are formed in the displacement spiral 13. A counterweight 28 is connected, preferably integrally, to the eccentric bearing 12 in order to compensate the imbalance arising from the orbiting movement of the displacement spiral 13.

Figure 3:
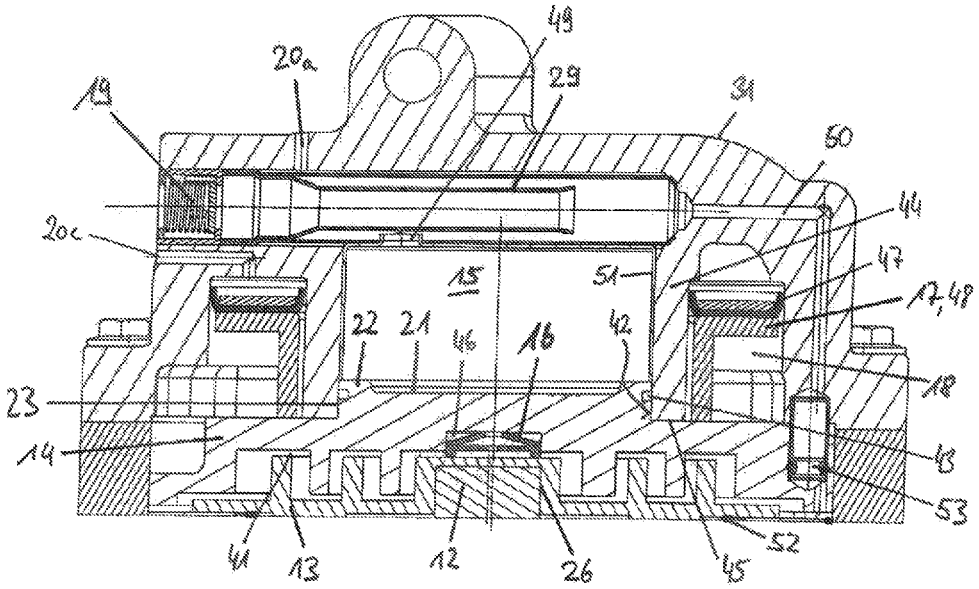
FIG. 3 shows a detail view of the scroll-type compressor as per FIG. 1, in the region of the housing cover.

The scroll-type compressor illustrated in FIGS. 1 and 2 does not have a clutch. To nevertheless be able to vary the power of the compressor, the scroll-type compressor can be activated and deactivated (digital switching). It is provided for this purpose that the counterpart spiral 14 can move in alternating fashion in an axial direction, that is to say in a direction parallel to the drive shaft 11. The displacement spiral 13 is fixed in the axial direction. In this way, the counterpart spiral 14 can be lifted from the displacement spiral 13 in the axial direction, as illustrated in FIGS. 1 to 3. In said open position, a pressure equalization gap 41 is formed between the displacement spiral 13 and the counterpart spiral 14, which pressure equalization gap connects the gas chambers, which are separated from one another in the radial direction, between the displacement spiral 13 and the counterpart spiral 14. This can be clearly seen from FIG. 3. Compressed gas from the chambers arranged further to the inside flows radially outward through said pressure equalization gap 41, whereby pressure equalization occurs. The power of the scroll-type compressor is thereby reduced to 0 or at least approximately to 0.

The axial guidance required for the axial mobility of the counterpart spiral 14 is realized by means of the pressure chamber 15, which furthermore dampens gas pulsations. The pressure chamber 15 thus has a dual function:

It is positioned downstream of the counterpart spiral in the flow direction and is fluidically connected to said counterpart spiral by the outlet (not illustrated) of the counterpart spiral 14. The outlet is not arranged exactly at the central point of the counterpart spiral 14 but rather is situated eccentrically in the region of the innermost chamber between the displacement spiral 13 and the counterpart spiral 14. It is achieved in this way that the outlet is not covered by the bearing bushing 26 of the eccentric bearing 12, and the fully compressed vapor can be discharged into the pressure chamber 15.

For the axial guidance of the counterpart spiral 14, the pressure chamber 15 forms, on the axial end facing toward the counterpart spiral 14, an inner sliding surface 42. The sliding surface 42 is machined and seals against the counterpart spiral 14. The rear wall 21 of the counterpart spiral 14 forms the base of the pressure chamber 15. The counterpart spiral 14 thus terminates directly at the pressure chamber 15. The rear wall 21 furthermore has a flange 22, in particular an annular flange 22, which bears against the sliding surface 42 of the pressure chamber 15. The flange 22 serves as an axial guide for the counterpart spiral 14 in the pressure chamber 15. On the outer circumference of the flange 22 there is formed a groove with a sealing means, for example a sealing ring 43. The pressure chamber 15 is delimited by a circumferential wall 44 which forms a stop 45 and which limits the axial movement of the counterpart spiral 14.

The pressure chamber 15 is provided in the housing cover 31. This facilitates the installation of the axially movable counterpart spiral 14. Furthermore, said pressure chamber has a rotationally symmetrical cross section.

Figure 4:
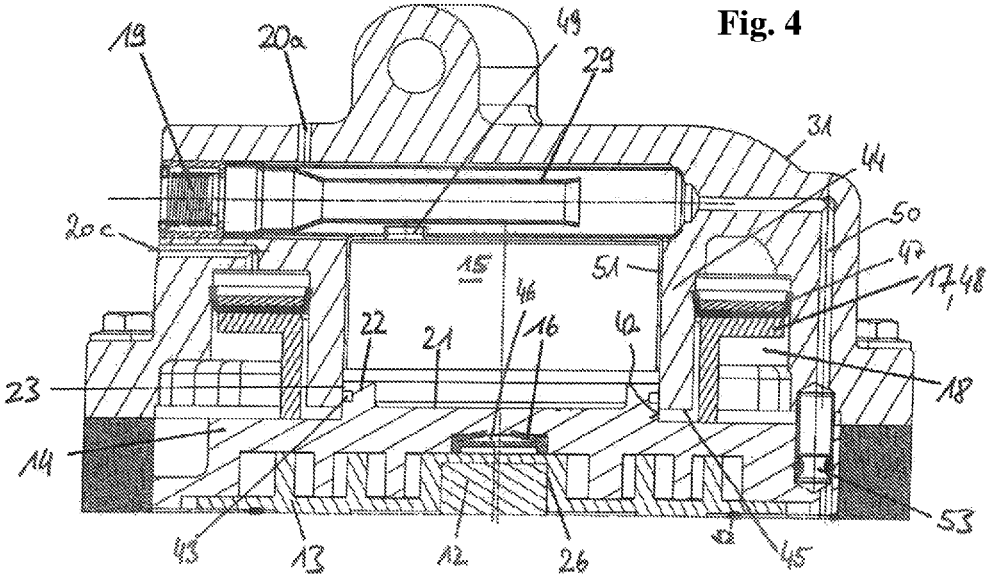
FIG. 4 shows a detail view as in FIG. 3, wherein the compressor is in the closed position.

Oppositely directed axial forces are required for the alternating movement of the counterpart spiral 14 between the open position (FIG. 3) and the closed position (FIG. 4). The axial force that moves the counterpart spiral 14 into the open position (FIG. 3) and thus releases the counterpart spiral 14 from the displacement spiral 13 (axial release force) is generated by a spring 16 that is arranged between the displacement spiral 13 and the counterpart spiral 14. The spring 16 may for example be in the form of a plate spring. In the closed position as per FIG. 4, the spring 16 is preloaded and forces the counterpart spiral 14 and the displacement spiral 13 apart.

As can be clearly seen in FIGS. 3 and 4, the spring 16 is arranged opposite the pressure chamber 15. For this purpose, there is provided in the counterpart spiral 14 a central recess 46 in which the spring 16 is arranged. The spring 16 is supported on the displacement spiral 13. For this purpose, it is provided that the bearing bushing 26 for the eccentric bearing 12 is arranged in a recessed manner in the displacement spiral 13. Here, the bearing bushing 26 protrudes into the counterpart spiral 14 and projects into the counterpart spiral 14. The base of the bearing bushing 26, on which base the spring 16 is supported, is situated at the same level as the inner edges of the windings of the displacement spiral 13. This can be clearly seen from FIG. 3 (open position). In the closed position as per FIG. 4, the base of the bearing bushing 26 thus bears against the counterpart spiral 14 and seals off the innermost gas chamber between the displacement spiral 13 and the counterpart spiral 14.

To move the counterpart spiral 14 from the open position illustrated in FIG. 3 into the closed position shown in FIG. 4, a piston 17, in particular an annular piston 17, is provided which is displaceable coaxially with respect to the longitudinal axis of the counterpart spiral 14. Instead of the annular piston 17, it is also possible for multiple cylindrical pistons to be provided which are arranged on the circumference of the counterpart spiral 14. The annular piston 17 engages on the rear wall 21 of the counterpart spiral 14 and exerts a closing force on said rear wall, which closing force acts counter to the spring force of the spring 16.

As can be seen in FIGS. 1 to 4, the piston 17 engages on the counterpart spiral 14 adjacent to the pressure chamber 15. The piston 17 is thus arranged outside the pressure chamber 15, or generally off-center. For the fluid connection between the counterpart spiral 14 and the pressure chamber 15, it is thus possible for a simple outlet opening to be formed (not illustrated) in the counterpart spiral 14.

The annular piston 17 has a pressure ring 47 that is connected to a base 48 of the piston. The piston base 48 is mounted in an axially displaceable and pressure-tight manner in an axial guide 18. The axial guide 18 is in the form of an annular chamber. For the actuation of the annular piston 17, the annular chamber is connected to a supply port 20*c*. As illustrated in FIG. 1, the supply port 20*c* is connected to a ⅔ directional valve, which in turn is connected to a high-pressure port 20*a* and to a suction-pressure port 20*b*, such that the annular chamber can be charged alternately with high pressure or suction pressure. In this way, the counterpart spiral 14 can be moved back and forth in alternating fashion between the open position or the closed position. Here, the annular piston 17 acts substantially only counter to the spring force of the spring 16, because the pressure which prevails in the pressure chamber 15 and which acts on the counterpart spiral 14 is at least partially compensated by the pressure that acts between the counterpart spiral 14 and the displacement spiral 13 during the compression. Furthermore, only relatively small lifting travels are required in order to set the pressure equalization gap 41. Lifting travels of approximately 0.3 to 0.7 mm, in particular a lifting travel of approximately 0.5 mm, are for example adequate.

Power regulation of the scroll-type compressor is realized by activation and deactivation of the compressor power, specifically by changing the frequency of the cyclic or alternating movement of the counterpart spiral 14.

The compressed gas that is collected in the pressure chamber 15 flows out of the pressure chamber 15 through an outlet 49 into an oil separator 29, which in the present case is in the form of a cyclone separator. The compressed gas flows through the oil separator 29 and a check valve 19 into the circuit of the air conditioning system. The check valve 19, which prevents a back flow of the compressed gas into the deactivated scroll-type compressor, is designed for example for pressure differences from 0.5 to 1 bar.

The sealing of the displacement spiral 13 against the counterpart spiral 14 in the axial direction is assisted by virtue of a rear wall 25 of the displacement spiral being acted on with high pressure. For this purpose, an accommodating space 24, also referred to as backpressure space (FIG. 1), in which a part of the counterweight 28 and the eccentric bearing 12 are arranged, is fluidically connected to the high-pressure side. The accommodating space 24 is delimited by the rear wall 25 of the compressor spiral 13 and by the housing intermediate wall 32.

The accommodating space 24 is fluidically separated from the suction space 33 by the second shaft seal 37 described in the introduction. A sealing and slide ring 52 is arranged between the displacement spiral 13 and the housing intermediate wall 32 and seals off the accommodating space 24 with respect to the high-pressure side. The sealing and slide ring 52 is seated in an annular groove in the housing intermediate wall 32. A gap (not illustrated) is formed between the housing intermediate wall 32 and the displacement spiral 13. The displacement spiral 13 is thus supported in the axial direction not directly on the housing intermediate wall 32 but rather on the sealing and slide ring 52, and slides on the latter. For this purpose, the sealing and slide ring 52 projects out of the annular groove and seals off the gap. The gap may be approximately 0.2 mm to 0.5 mm wide.

For the connection to the high-pressure side, a line 50 connects the oil separator 29 to the accommodating space 24. Said line extends through the housing cover 31, through the counterpart spiral 14 and through the intermediate wall 32. Between the oil separator 29 and the accommodating space 24, specifically between the counterpart spiral 14 and the housing cover 31, there is arranged a pressure reducer 53 which ensures that a pressure difference of approximately 10%-20% prevails between the high-pressure side and the accommodating space 24. It is achieved in this way that, in the closed position, the axial surface pressure between the displacement spiral 13 and the counterpart spiral 14, and thus the axial sealing action, is increased.

From a thermal aspect, the scroll-type compressor illustrated in FIG. 1 is optimized such that undesired heating of the refrigerant vapor on the suction side is prevented. For this purpose, the pressure chamber 15 is encapsulated (see FIG. 4). The pressure chamber 15 is otherwise free from internals. For example, the pressure chamber may have an internal jacket 51, which may be composed in particular of high-grade steel or rust-resistant steel. The internal jacket 51 exhibits lower thermal conductivity than aluminum. The thermal insulation of the oil separator 29 additionally reduces the heating of the refrigerant vapor on the suction side. Here, too, the thermal insulation is realized by means of an encapsulation, for example by means of an internal jacket composed of high-grade steel or rust-resistant steel, which surrounds the cyclone separator. The pressure reducer 53 is also insulated by means of an encapsulation with an internal jacket composed of high-grade steel or rust-resistant steel.

In this way, it is possible for the housing cover 31 to be manufactured for example from aluminum, without there being the risk of excessive heat transfer from the high-pressure side to the suction side.

Figure 5:
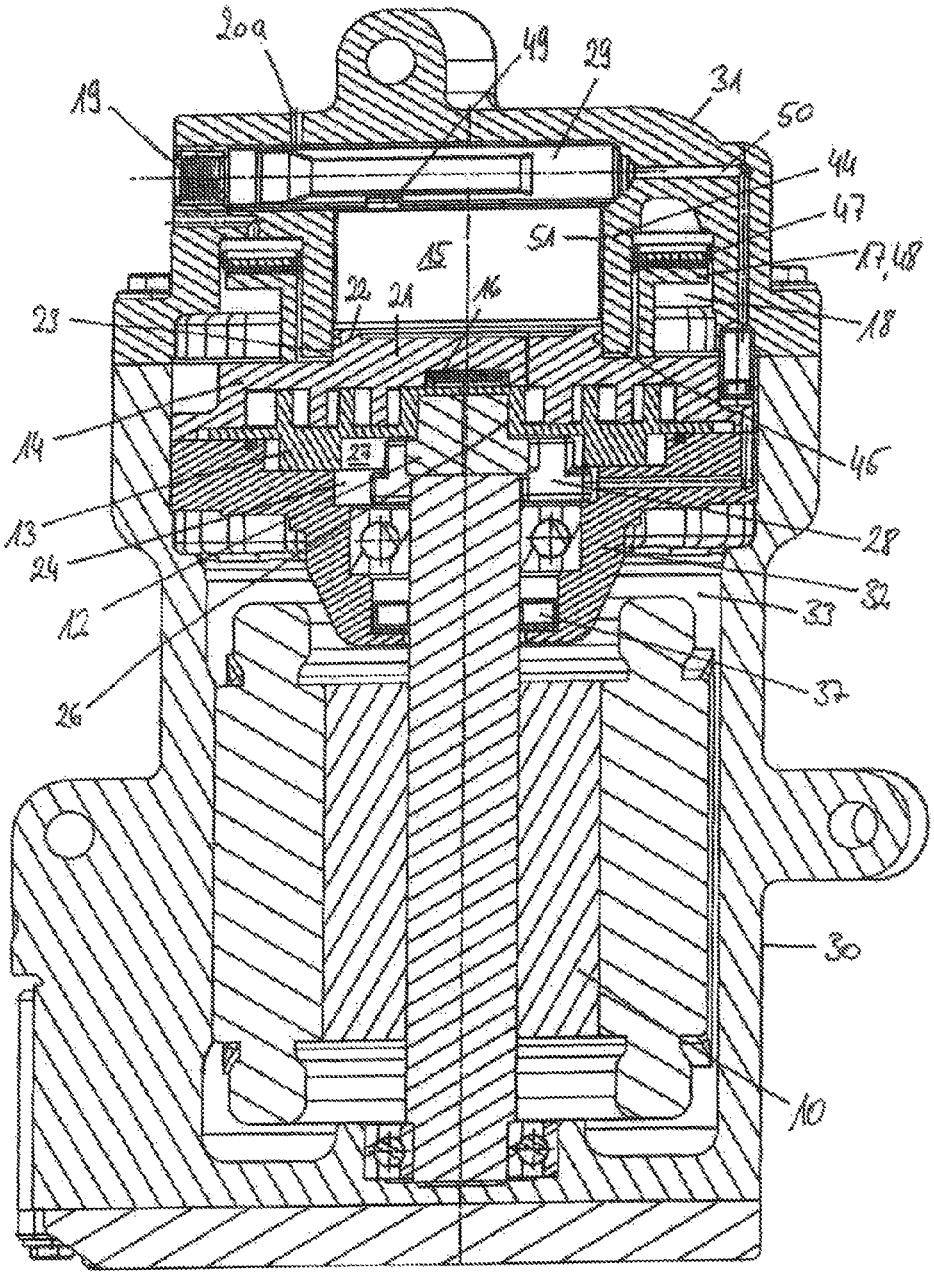
FIG. 5 shows a longitudinal section through a compressor as per a further exemplary embodiment according to the invention, having an electric drive with constant or fixed rotational speed.

The only difference between the scroll-type compressor as per FIG. 5 and the scroll-type compressor as per FIG. 1 consists in that, instead of the mechanical drive, use is made of an electric drive with constant rotational speed, that is to say a rotational speed that does not vary with time. Reference is otherwise made to the statements made in conjunction with the mechanically driven scroll-type compressor.

Figure 6:
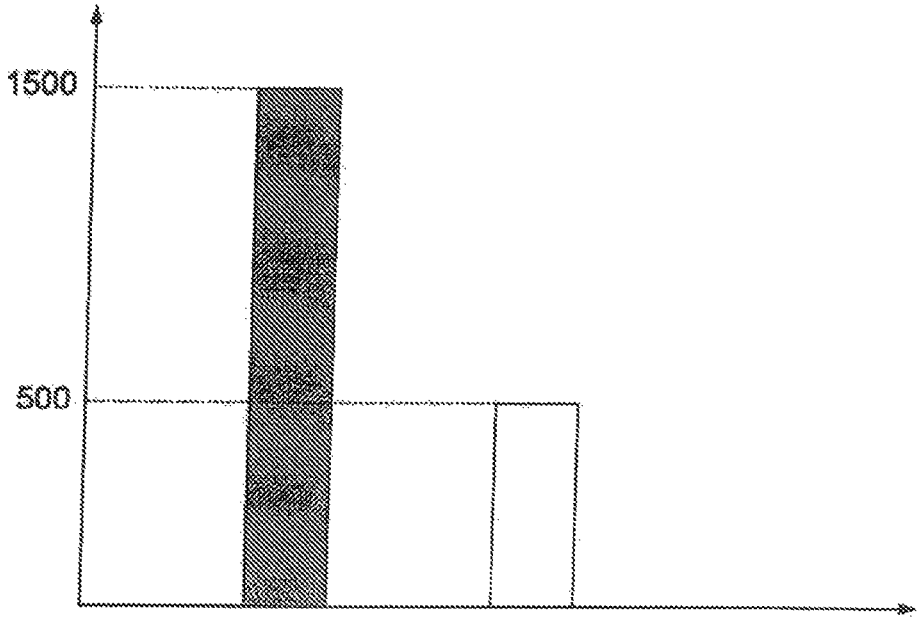
FIG. 6 shows a comparison of the mass inertia of the entire compressor, in $kgmm^2$, with the prior art.
Figure 7:
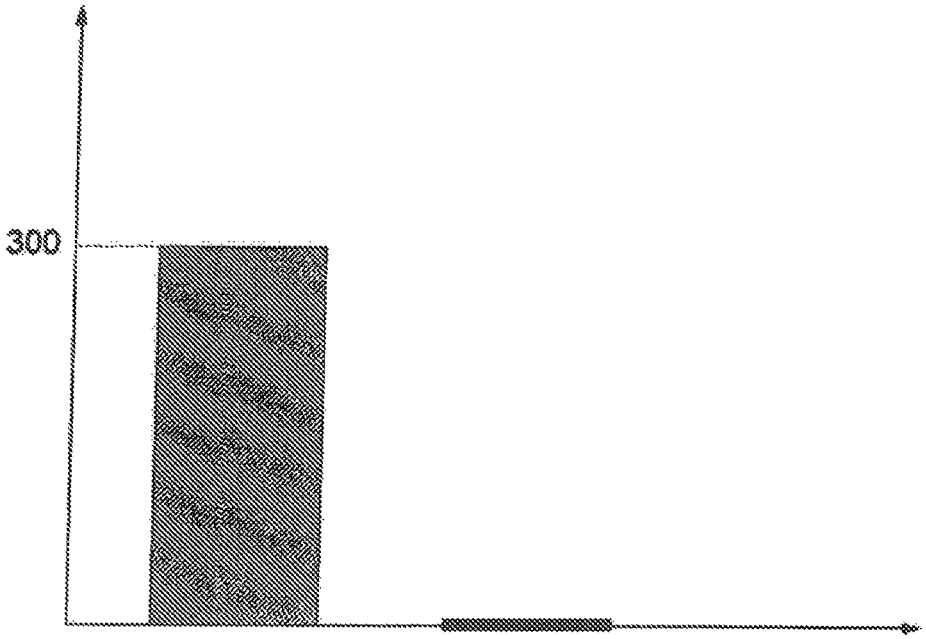
FIG. 7 shows a comparison of the effective mass inertia upon the activation of the compressor, in $kgmm^2$, with the prior art.
Figure 8:
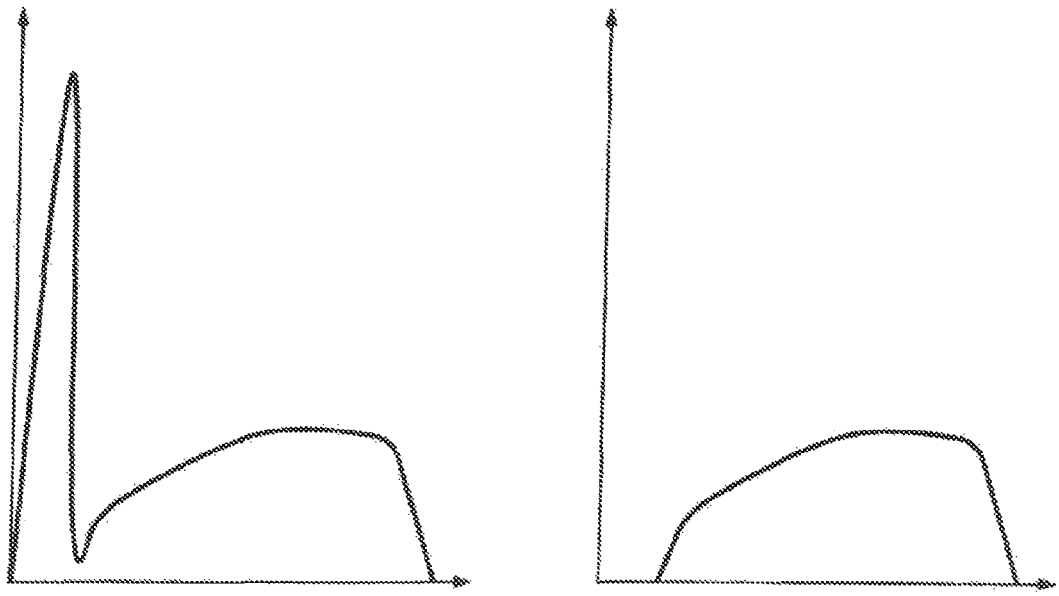
FIG. 8 shows a comparison diagram of the activation torque in Nm.

The advantages of the scroll-type compressor according to the invention are illustrated in FIGS. 6 to 8. FIG. 6 shows a diagram illustrating the mass inertia of the entire scroll-type compressor in $kgmm^2$, wherein the left-hand gray column with 1500 $kgmm^2$ represents the prior art and the right-hand white column represents the invention. The invention leads to an improvement in the mass inertia by a factor of 3. Since the displacement spiral 13 co-rotates in the deactivated state, the mass inertia upon the activation of the scroll-type compressor is practically zero. By contrast, the effective mass inertia upon the activation of a compressor from the prior art is up to 300 $kgmm^2$. The resulting activation torque for the motor is shown in FIG. 8, wherein the left-hand diagram shows the torque peak in the case of a motor known from the prior art, and the right-hand diagram shows the torque profile upon the activation of a scroll-type compressor according to the invention.

LIST OF REFERENCE SIGNS

10 Drive
11 Drive shaft
12 Eccentric position
13 Displacement spiral
14 Counterpart spiral
15 Pressure chamber
16 Spring
17 Piston/annular piston

18 Piston guide
19 Check valve
20*a* High-pressure port
20*b* Suction pressure port
20*c* Supply port
21 Rear wall of counterpart spiral
22 Flange
23 Inner wall
24 Accommodating space
25 Rear wall of displacement spiral
26 Bearing bushing
27 Recess
28 Counterweight
29 Oil separator
30 Weight
31 Housing cover
32 Housing intermediate wall
33 Suction chamber
34 Housing base
35 Driver
36 First shaft seal
37 Second shaft seal
38 Eccentric pin
39 Guide pins
40 Guide bores
41 Pressure equalization gap
42 Sliding surface
43 Sealing ring
44 Wall
45 Stop
46 Central recess
47 Pressure ring
48 Piston base
49 Outlet
50 Line
51 Internal jacket
52 Slide and sealing ring
53 Pressure reducer

What is claimed is:

1. A scroll-type compressor for a $CO_2$ vehicle air conditioning system, having a drive which is connected to an eccentric bearing by a drive shaft, and having a movable displacement spiral which is rotatably connected to the eccentric bearing and which engages into a counterpart spiral such that, between the movable displacement spiral and the counterpart spiral, radially inwardly traveling chambers are formed in order to compress the refrigerant and discharge it into a pressure chamber, wherein the drive is a mechanical drive or an electric drive with a fixed rotational speed, and the counterpart spiral is alternatingly movable relative to the movable displacement spiral in an axial direction, wherein, between the counterpart spiral and the movable displacement spiral, there is arranged at least one spring for exerting an axial release force on the counterpart spiral, and at least one piston engages on the counterpart spiral, in order to exert an axial closing force on the latter, adjacent to the pressure chamber.

2. The scroll-type compressor as claimed in claim 1, wherein the spring is arranged opposite the pressure chamber.

3. The scroll-type compressor as claimed in claim 1, wherein the piston comprises an annular piston which is arranged so as to be displaceable coaxially with respect to the counterpart spiral.

4. The scroll-type compressor as claimed in claim 1, wherein the piston is mounted in a piston guide that is alternatively connected to a high-pressure side and to a suction side of the scroll-type compressor in alternating fashion.

5. The scroll-type compressor as claimed in claim 1, wherein a check valve is positioned downstream of the pressure chamber in the flow direction.

6. The scroll-type compressor as claimed in claim 5, wherein a port for the connection of the piston guide to the high-pressure side is arranged between the pressure chamber and the check valve.

7. The scroll-type compressor as claimed in claim 1, wherein a rear wall, arranged on the high-pressure side, of the counterpart spiral forms a base of the pressure chamber and has a flange that bears against an inner wall of the pressure chamber.

8. The scroll-type compressor as claimed in claim 1, wherein an accommodating space, which is closed off with respect to the suction side, for the eccentric bearing is fluidically connected to the pressure chamber, and a rear wall of the movable displacement spiral is acted on with a surface pressure.

9. The scroll-type compressor as claimed in claim 1, wherein a distance between the central point of the counterpart spiral and the central point of the movable displacement spiral is at most 1.5 mm.

10. The scroll-type compressor as claimed in claim 1, wherein the counterpart spiral has a winding angle of 660° to 720°.

11. The scroll-type compressor as claimed in claim 1, wherein the scroll-type compressor has a mass moment of inertia that is less than 500 $kgmm^2$.

12. The scroll-type compressor as claimed in claim 1, wherein the eccentric bearing is arranged in a displacement chamber between the movable displacement spiral and the counterpart spiral and has a bearing bushing which is formed integrally with the movable displacement spiral and a base of which is in alignment with the face side of the windings of the movable displacement spiral.

13. The scroll-type compressor as claimed in claim 1, wherein the movable displacement spiral has a central recess in which there is at least partially accommodated a counterweight which is connected to the eccentric bearing.

14. The scroll-type compressor as claimed in claim 1, wherein a volume of the pressure chamber is greater by a factor of 5-7 than the suction volume per revolution of the movable displacement spiral, and the pressure chamber is thermally insulated.

15. A vehicle air conditioning system that comprises $CO_2$ as refrigerant, having a scroll-type compressor as claimed in claim 1.

* * * * *